US008997996B2

(12) United States Patent
Kuo et al.

(10) Patent No.: US 8,997,996 B2
(45) Date of Patent: Apr. 7, 2015

(54) DRAWER TYPE CUSHIONING PACKAGING DEVICE FOR LIQUID CRYSTAL GLASS

(71) Applicant: Shenzhen China Star Optoelectronics Technology Co., Ltd., Shenzhen, Guangdong (CN)

(72) Inventors: Yi-cheng Kuo, Guangdong (CN); Shih-hsiang Chen, Guangdong (CN); Qinjun Shi, Guangdong (CN); Jiahe Cheng, Guangdong (CN); Chengwen Que, Guangdong (CN); Jiaxin Li, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 55 days.

(21) Appl. No.: 13/982,488

(22) PCT Filed: Jun. 28, 2013

(86) PCT No.: PCT/CN2013/078259

§ 371 (c)(1),
(2) Date: Jul. 30, 2013

(87) PCT Pub. No.: WO2014/146374

PCT Pub. Date: Sep. 25, 2014

(65) Prior Publication Data

US 2014/0262929 A1 Sep. 18, 2014

(30) Foreign Application Priority Data

Mar. 18, 2013 (CN) ..... 2013 1 0086508

(51) Int. Cl.
*B65D 85/00* (2006.01)
*B65D 85/48* (2006.01)
(Continued)

(52) U.S. Cl.
CPC ..... *B65D 85/48* (2013.01); *A47B 87/0253* (2013.01); *A47B 87/02* (2013.01); *B65D 81/113* (2013.01)

(58) Field of Classification Search
CPC ..... B65D 85/48; B65D 84/30; B65D 81/113; B65D 83/0847; B65D 85/62; B65D 77/042; B65D 71/70; B65D 71/00; B65D 5/021; B65D 5/5035; B65G 49/07; B65G 49/05; B65G 49/06; H01L 21/67369; H01L 21/67359; H01L 21/67363; H01L 21/67383; H01L 21/673; H01L 21/37386; B60P 3/002; G03F 1/60; G03F 1/66; B42F 7/10; B42F 7/12; B42F 7/14; A47B 47/02; A47B 47/021; A47B 55/00; A47B 55/02; A47B 96/00; A47B 96/02; A47B 97/00; A47B 47/0091; A47B 87/00; A47B 87/001; A47B 87/02; A47B 87/0207; A47B 87/0246; A47B 87/0253; A47B 87/0261; A47B 87/0269
USPC ..... 211/41.18, 13.1, 134, 59.4, 133.5, 188, 211/194, 41.14; 206/454, 449, 499, 521, 206/722
See application file for complete search history.

(56) References Cited

U.S. PATENT DOCUMENTS 3,486,631 A * 12/1969 Rodman ..... 211/41.18
4,202,452 A * 5/1980 McCormick ..... 211/41.14
(Continued)

FOREIGN PATENT DOCUMENTS

CN 1558271 A 12/2004
CN 1572672 A 2/2005
(Continued)

OTHER PUBLICATIONS

International Search Report of PCT Patent Application No. PCT/CN2013/078259 issued on Dec. 26, 2013.
(Continued)

*Primary Examiner* — Jennifer E Novosad

(57) ABSTRACT

The present disclosure provides a drawer type cushioning packaging device for liquid crystal glasses, including several cushioning packing boxes and a rack. The rack includes a bottom plate and a pair of symmetrically configured supporting brackets, each of the supporting brackets includes at least one standing post and several supporting plates; a lower portion of each standing post is connected to the bottom plate; each of the supporting plates is connected to one side of the corresponding standing post and is located above the bottom plate; and each of the cushioning packing boxes is placed on the corresponding supporting plate.

10 Claims, 4 Drawing Sheets

(51) Int. Cl.
*A47B 87/02* (2006.01)
*B65D 81/113* (2006.01)

(56) References Cited

U.S. PATENT DOCUMENTS

| | | | | |
|---|---|---|---|---|
| 4,919,277 | A * | 4/1990 | Jeruzal | 211/85.8 |
| 5,641,076 | A * | 6/1997 | Englund | 211/41.14 |
| 5,823,361 | A * | 10/1998 | Babbs | 211/41.17 |
| 5,847,813 | A * | 12/1998 | Hirayanagi | 355/75 |
| 5,890,598 | A * | 4/1999 | Hayashida et al. | 206/710 |
| 6,135,299 | A * | 10/2000 | Burgess | 211/194 |
| 6,145,663 | A * | 11/2000 | Kim et al. | 206/454 |
| 6,186,344 | B1 * | 2/2001 | Park et al. | 211/41.1 |
| 6,273,275 | B1 * | 8/2001 | Kim et al. | 211/41.18 |
| 6,464,092 | B1 * | 10/2002 | Kortman et al. | 211/194 |
| 6,722,500 | B2 * | 4/2004 | Deiger | 206/454 |
| 6,997,318 | B2 * | 2/2006 | Park | 206/454 |
| 7,064,808 | B1 * | 6/2006 | Gilissen et al. | 355/72 |
| 7,188,736 | B2 * | 3/2007 | Choi | 211/41.18 |
| 7,225,925 | B2 * | 6/2007 | Chen et al. | 206/454 |
| 7,334,691 | B2 * | 2/2008 | Liu | 211/41.18 |
| 7,374,044 | B2 * | 5/2008 | Ting | 206/454 |
| 7,463,338 | B2 * | 12/2008 | Kurikawa | 355/75 |
| 7,978,279 | B2 * | 7/2011 | Chung | 349/58 |
| 8,342,327 | B1 * | 1/2013 | Nam et al. | 206/454 |
| 8,371,456 | B2 * | 2/2013 | Scadden et al. | 211/59.4 |
| 8,528,750 | B2 * | 9/2013 | Heo | 211/41.18 |
| 2003/0121870 | A1 * | 7/2003 | Beckhart et al. | 211/41.18 |
| 2004/0069728 | A1 * | 4/2004 | Huang et al. | 211/41.18 |
| 2004/0108284 | A1 * | 6/2004 | Huang et al. | 211/41.18 |
| 2004/0164035 | A1 * | 8/2004 | Jang | 211/41.14 |
| 2004/0200788 | A1 * | 10/2004 | Shon et al. | 211/41.18 |
| 2006/0032826 | A1 * | 2/2006 | Liu | 211/41.18 |
| 2006/0266718 | A1 * | 11/2006 | Tischner et al. | 211/41.18 |
| 2007/0210020 | A1 * | 9/2007 | Choi | 211/41.18 |
| 2008/0128310 | A1 * | 6/2008 | Kao et al. | 206/521 |
| 2010/0224524 | A1 * | 9/2010 | Yuasa et al. | 206/454 |
| 2011/0215019 | A1 * | 9/2011 | Wu et al. | 206/523 |
| 2013/0240472 | A1 * | 9/2013 | Preidt et al. | 211/153 |
| 2013/0334082 | A1 * | 12/2013 | Zhao et al. | 206/316.1 |
| 2014/0332432 | A1 * | 11/2014 | Zhou | 206/454 |

FOREIGN PATENT DOCUMENTS

| | | | |
|---|---|---|---|
| CN | 201172502 | Y | 12/2008 |
| CN | 202295888 | U | 7/2012 |

OTHER PUBLICATIONS

1st Office Action of counterpart Chinese Patent Application No. 201310086508.3 issued on Jul. 25, 2014.

* cited by examiner

DRAWER TYPE CUSHIONING PACKAGING DEVICE FOR LIQUID CRYSTAL GLASS

BACKGROUND

1. Technical Field

The present invention relates to technologies of storing devices, and particularly, to a drawer type cushioning packaging device for liquid crystal glasses.

2. Description of Related Art

In existing industries, cushioning packages for liquid crystal glasses are stacked in a way that each piece of glass is laid down and all cushioning packing boxes are piled up in sequence, layer-by-layer. This causes the situation that before taking out one certain middle packing box or one bottom packing box, all the other packing boxes placed on the taken-out packing box are needed to be moved away. In addition, since the bottom packing box needs to bear the weights of all the other packing boxes and the products placed thereon, it requires each packing box to have relatively thicker side wall and bottom wall, which causes each packing box to have a great thickness and is unbeneficial to the reduction of the packing cost.

SUMMARY

The main object of the present disclosure is to provide a drawer type cushioning packaging device for liquid crystal glasses, for solving the problems caused by the simple stacking of the cushioning packing box, including uneasy placing and picking of a cushioning packing box, and great thickness and high manufacturing cost of the cushioning packing box.

For achieving the above object, the drawer type cushioning packaging device for liquid crystal glasses provided in an embodiment of the present disclosure includes several cushioning packing boxes and a rack, wherein the rack includes a bottom plate and a pair of symmetrically configured supporting brackets, each of the supporting brackets includes at least one standing post and several supporting plates; a lower portion of each standing post is connected to the bottom plate; each of the supporting plates is connected to one side of the corresponding standing post and is located above the bottom plate; and each of the cushioning packing boxes is placed on the corresponding supporting plate.

Preferably, a limiting piece is configured at a top end of each standing post.

Preferably, the limiting piece is L shaped and is tilted towards a direction away from a connection end of each of the supporting plates and the corresponding standing post.

Preferably, the limiting piece is tilted at an angle ranging from 5 to 10 degrees.

Preferably, a connection point of the bottom plate and each standing post is distant from ground for 90 to 120 mm.

Preferably, the drawer type cushioning packaging device for liquid crystal glasses further includes a side plate, one side wall of the side plate is connected to end portions of the supporting plates, and a bottom portion of the side plate is connected to the bottom plate.

Preferably, the bottom plate, the side plate, and the supporting plate respectively have a square frame structure formed by welding metal ribs.

Preferably, the supporting plates are evenly spaced and parallel to each other, and the supporting plates are perpendicularly connected to the standing post.

Preferably, the number of the standing post of each of the supporting brackets is two.

Preferably, at least one groove engageable with the corresponding supporting plate is defined at a bottom portion of each of the cushioning packing boxes.

The present disclosure further provides another drawer type cushioning packaging device for liquid crystal glasses, including several cushioning packing boxes and a rack, wherein the rack includes a bottom plate and a pair of symmetrically configured supporting brackets, each of the supporting brackets includes at least one standing post and several supporting plates; a lower portion of each standing post is connected to the bottom plate and a top end of each standing post is configured with a limiting piece; each of the supporting plates is connected to one side of the corresponding standing post and is configured on the bottom plate; and the cushioning packing boxes are respectively placed on the supporting plates.

Preferably, the limiting piece is L shaped and is tilted towards a direction away from a connection end of each of the supporting plates and the corresponding standing post.

Preferably, the limiting piece is tilted at an angle ranging from 5 to 10 degrees.

Preferably, a connection point of the bottom plate and each standing post is distant from ground for 90 to 120 mm.

Preferably, the drawer type cushioning packaging device for liquid crystal glasses further includes a side plate, one side wall of the side plate is connected to end portions of the supporting plates, and a bottom portion of the side plate is connected to the bottom plate.

Preferably, the bottom plate, the side plate, and the supporting plate respectively have a square frame structure formed by welding metal ribs.

Preferably, the supporting plates are evenly spaced and parallel to each other, and the supporting plates are perpendicularly connected to the corresponding standing post.

Preferably, the number of the standing post of each of the supporting brackets is two.

Preferably, at least one groove engageable with the corresponding supporting plate is defined at a bottom portion of each of the cushioning packing boxes.

The drawer type cushioning packaging device for liquid crystal glasses of the present disclosure includes several cushioning packing boxes and the rack. The rack is configured with several supporting plates, and the bottom portion of each of the cushioning packing boxes is configured with the groove engageable with the corresponding supporting plate. When the cushioning packing box is inserted into the rack, each supporting plate can support the corresponding cushioning packing box, which avoids the problem caused by the simple stacking of the cushioning packing boxes and allows for the convenient extraction of the needed cushioning packing box by extracting the cushioning packing box on the corresponding layer.

DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment is this disclosure are not necessarily to the same embodiment, and such references mean at least one.

Figure 1:
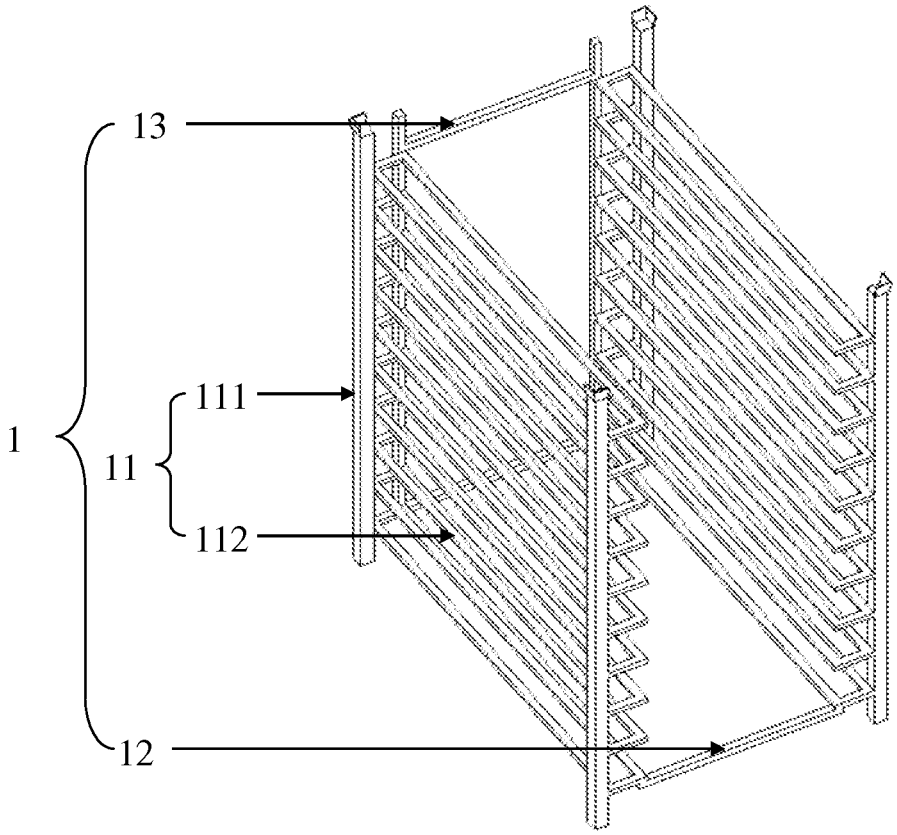
FIG. 1 is a schematic view of a drawer type cushioning packaging device for liquid crystal glasses in accordance with an embodiment of the present disclosure.
Figure 2:
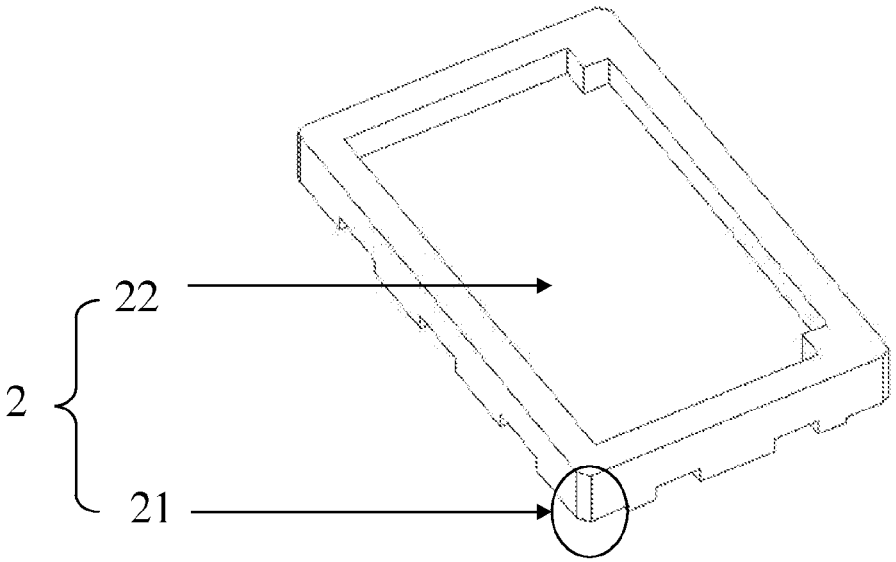
FIG. 2 is a schematic view of a cushioning packing box of the drawer type cushioning packaging device for liquid crystal glasses in accordance with an embodiment of the present disclosure.
Figure 3:
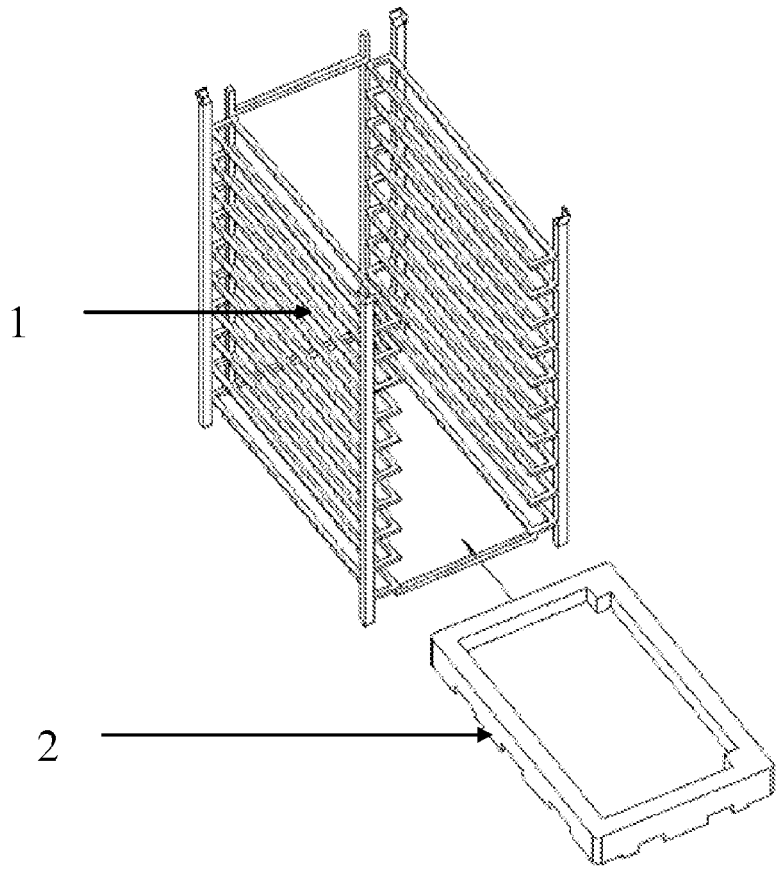
FIG. 3 is a schematic view showing an assembly process of a rack and the cushioning packing box of the drawer type cushioning packaging device for liquid crystal glasses in accordance with an embodiment of the present disclosure.
Figure 4:
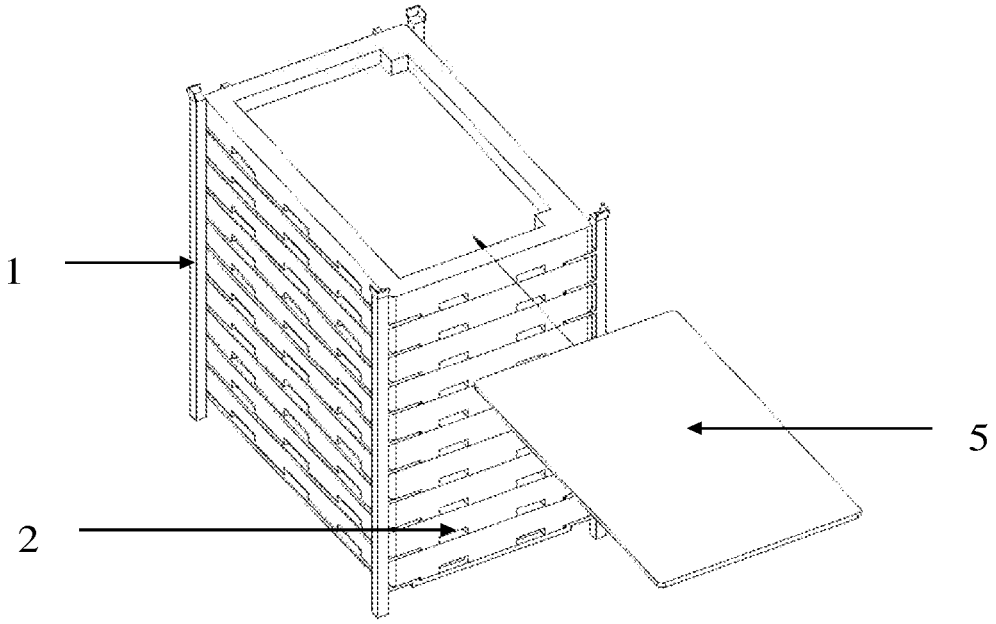
FIG. 4 is a perspective view showing the effect after the rack and the cushioning packing box of the drawer type cushioning packaging device for liquid crystal glasses are assembled together in accordance with an embodiment of the present disclosure.
Figure 5:
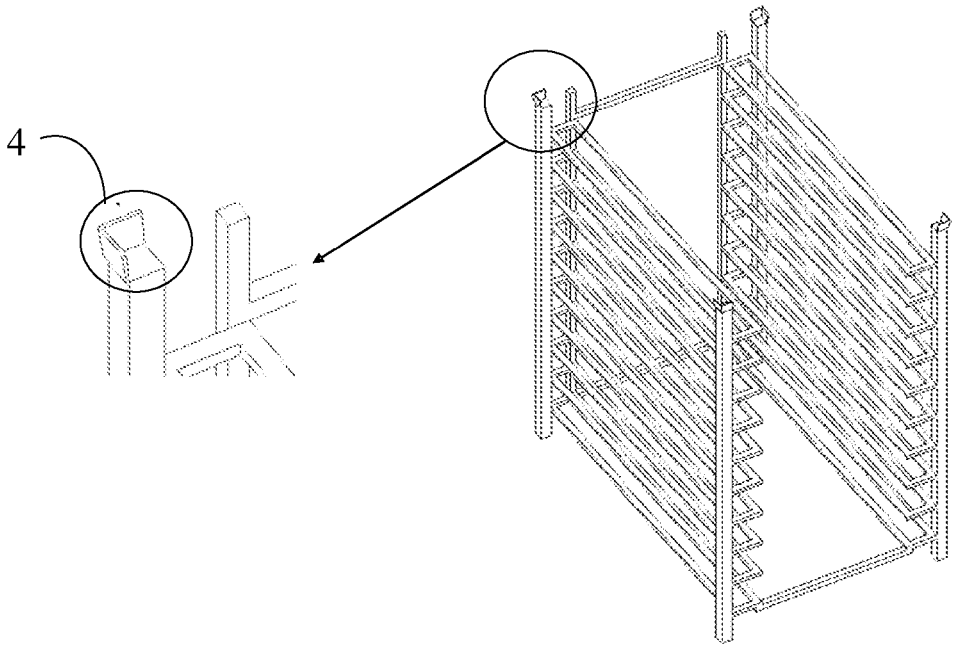
FIG. 5 is a schematic view of a limiting piece of a standing post of the drawer type cushioning packaging device for liquid crystal glasses in accordance with an embodiment of the present disclosure.
Figure 6:
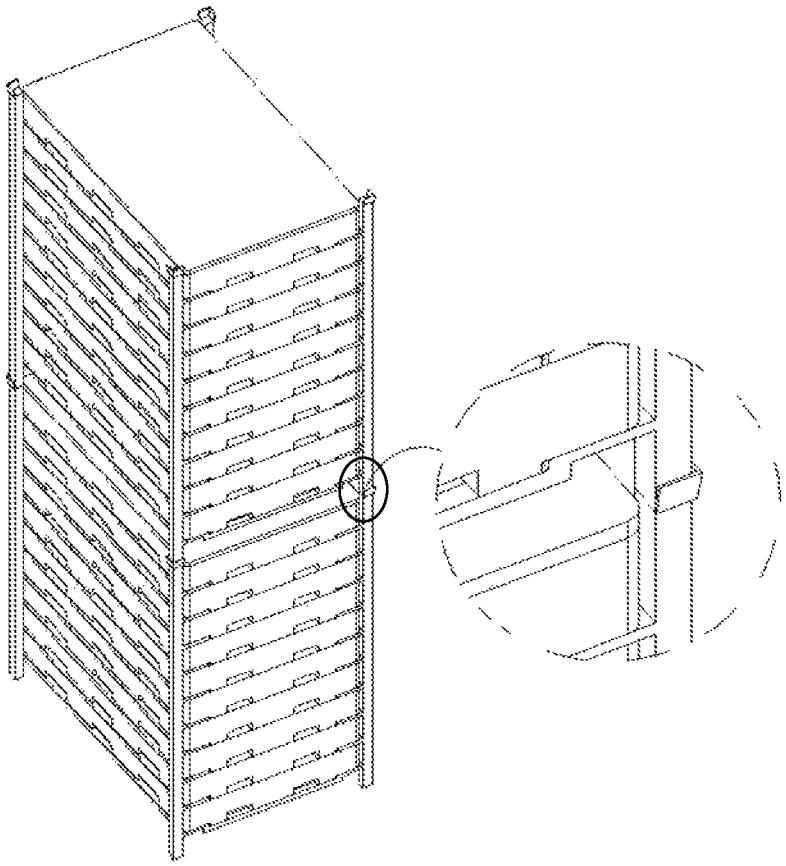
FIG. 6 is a schematic view illustrating two layers of the racks of the drawer type cushioning packaging device for liquid crystal glasses being stacked together in accordance with an embodiment of the present disclosure.

Referring to FIGS. 1 to 6, wherein FIG. 1 is a schematic view of a drawer type cushioning packaging device for liquid crystal glasses in accordance with an embodiment of the present disclosure; FIG. 2 is a schematic view of a cushioning packing box of the drawer type cushioning packaging device for liquid crystal glasses in accordance with an embodiment of the present disclosure; FIG. 3 is a schematic view showing an assembly process of a rack and the cushioning packing box of the drawer type cushioning packaging device for liquid crystal glasses in accordance with an embodiment of the present disclosure; FIG. 4 is a perspective view showing the effect after the rack and the cushioning packing box of the drawer type cushioning packaging device for liquid crystal glasses are assembled together in accordance with an embodiment of the present disclosure; FIG. 5 is a schematic view of a limiting piece of a standing post of the drawer type cushioning packaging device for liquid crystal glasses in accordance with an embodiment of the present disclosure; and FIG. 6 is a schematic view illustrating two layers of the racks of the drawer type cushioning packaging device for liquid crystal glasses being stacked together in accordance with an embodiment of the present disclosure.

The drawer type cushioning packaging device for liquid crystal glasses provided in an embodiment of the present disclosure includes several cushioning packing boxes 2 and a rack 1. The rack 1 includes a bottom plate 12, a pair of symmetrically-configured supporting brackets 11, and a side plate 13. Each supporting bracket 11 includes four standing posts 111 and several supporting plates 112 for supporting corresponding products. A lower portion of each standing post 111 is connected to the bottom plate 12. Two ends of each supporting plate 112 are respectively connected to the same sides of two standing posts 111, and each supporting plate 112 is perpendicular to the corresponding standing post 111 and is configured above the bottom plate 12. Each cushioning packing box 2 is placed on the corresponding supporting plate 112, a side wall of the side plate 13 is connected to an end portion of each supporting plate 12, and a bottom portion of the side plate 13 is connected to the bottom plate 12. In specific application, a space is defined between the symmetrically configured supporting brackets 11. The space is divided into a number of layers by the longitudinally adjacent supporting plates 112 which are evenly spaced and parallel to each other. Each cushioning packing box 2 is inserted onto the corresponding supporting plate 112 when being stored and is extracted directly when needed. The side plate 13 not only can strengthen the whole structure of the rack 1, but also can prevent the cushioning packing boxes 2 from sliding out at one side of the rack 1 which the side plate 13 is configured in.

Since the supporting plates 112 of the rack 1 can respectively support the cushioning packing boxes 2, high requirements of housing material of each cushioning packing box 2 due to the simple stacking of the cushioning packing boxes 2 can be avoided. This simultaneously facilitates the picking and placing of each cushioning packing box 2.

In practical application, in order to allow for the transportation of the rack by using a forklift, the connection point of the bottom plate 12 and each standing post 111 is distant from ground for 90 to 120 mm. Furthermore, the cushioning packaging device of the embodiment further includes an upper cover 5 for covering the cushioning packing box 2 placed on the top layer of the rack 1, which can prevent dusts from entering a product receiving chamber 22 of each cushioning packing box 2 and thus can avoid the pollution of the products.

In a further application process, in order to prevent the cushioning packing box 2 from becoming loosening or even falling off after the cushioning packing box 2 is placed on the supporting plate 112, two grooves 21 are respectively defined at two sides of the bottom portion of the cushioning packing box 2. The grooves 21 engage with the corresponding supporting plate 112 to tighten the connection between the cushioning packing box 2 and the supporting plate 112.

In a further application process, in order to save the storage space, an L-shaped limiting piece 4 is configured at a top end of each standing post 111 of each supporting bracket 11. The limiting piece 4 is tilted towards a direction away from the connection end of the supporting plate 112 and the standing post 111 at an angle ranging from 5 to 10 degrees. The storage space can be saved to the greatest extent by placing a first drawer type cushioning packaging device for liquid crystal glasses above a second drawer type cushioning packaging device for liquid crystal glasses in a way shown in FIG. 6.

In a further application process, in order to reduce the manufacturing cost of the present disclosure to the greatest extent, in the embodiment, the bottom plate 12, the side plate 13 respectively use a square frame structure formed by welding four metal ribs together.

Compared with the conventional method in which the cushioning packing boxes are stacked together simply, the present disclosure can transfer the action force between the cushioning packing boxes to the rack, which allows the present disclosure to have the following advantages:

(1) The cushioning packing boxes of the present disclosure can be placed and picked conveniently.

(2) The structure of the rack of the present disclosure is simple and the manufacturing cost thereof is low.

(3) The thicknesses of the side wall and the bottom portion of the cushioning packing boxes can be less, which is beneficial for the reduction of the material cost.

(4) The present disclosure can reduce the required storage space to the greatest extent.

Even though information and the advantages of the present embodiments have been set forth in the foregoing description, together with details of the mechanisms and functions of the present embodiments, the disclosure is illustrative only; and that changes may be made in detail, especially in matters of shape, size, and arrangement of parts within the principles of the present embodiments to the full extend indicated by the broad general meaning of the terms in which the appended claims are expressed.

What is claimed is:

1. A drawer type cushioning packaging device for liquid crystal glasses, comprising several cushioning packing boxes and a rack, wherein the rack comprises a bottom plate and a pair of symmetrically configured supporting brackets, each of the supporting brackets comprises at least two standing posts and several supporting plates; a lower portion of each standing post is connected to the bottom plate; each of the supporting plates is connected to one side of the corresponding standing post and is located above the bottom plate; and each of the cushioning packing boxes is placed on the corresponding supporting plate, wherein:

a limiting piece is configured at a top end of each standing post;

the limiting piece is L shaped and is tilted outwards toward a direction away from a connection end of each of the supporting plates and the corresponding standing post;

the limiting piece is tilted at an angle ranging from 5 to 10 degrees;

a distant between a connection point of the bottom plate and each standing post and the ground is between 90 and 120 mm; and the drawer type cushioning packaging device for liquid crystal glasses further comprises a side plate, one side wall of the side plate is connected to end portions of the supporting plates, and a bottom portion of the side plate is connected to the bottom plate.

2. The drawer type cushioning packaging device for liquid crystal glasses of claim 1, wherein the bottom plate, the side plate, and each of the supporting plates respectively has a rectangular frame structure formed by welding metal ribs.

3. The drawer type cushioning packaging device for liquid crystal glasses of claim 2, wherein the supporting plates are evenly spaced and parallel to each other, and the supporting plates are perpendicularly connected to the standing post.

4. The drawer type cushioning packaging device for liquid crystal glasses of claim 2, wherein the number of the standing posts of each of the supporting brackets is two.

5. The drawer type cushioning packaging device for liquid crystal glasses of claim 2, wherein at least one groove engageable with the corresponding supporting plate is defined at a bottom portion of each of the cushioning packing boxes.

6. A drawer type cushioning packaging device for liquid crystal glasses, comprising several cushioning packing boxes and a rack, wherein the rack comprises a bottom plate and a pair of symmetrically configured supporting brackets, each of the supporting brackets comprises at least two standing posts and several supporting plates; a lower portion of each standing post is connected to the bottom plate and a top end of each standing post is configured with a limiting piece; each of the supporting plates is connected to one side of the corresponding standing post and is located above the bottom plate; and the cushioning packing boxes are respectively placed on the supporting plates, wherein:

the limiting piece is L shaped and is tilted outwards toward a direction away from a connection end of each of the supporting plates and the corresponding standing post;

the limiting piece is tilted at an angle ranging from 5 to 10 degrees;

a distant between a connection point of the bottom plate and each standing post and the ground is between 90 and 120 mm; and the drawer type cushioning packaging device for liquid crystal glasses further comprises a side plate, one side wall of the side plate is connected to end portions of the supporting plates, and a bottom portion of the side plate is connected to the bottom plate.

7. The drawer type cushioning packaging device for liquid crystal glasses of claim 6, wherein the bottom plate, the side plate, and each of the supporting plates respectively has a rectangular frame structure formed by welding metal ribs.

8. The drawer type cushioning packaging device for liquid crystal glasses of claim 7, wherein the supporting plates are evenly spaced and parallel to each other, and the supporting plates are perpendicularly connected to the corresponding standing post.

9. The drawer type cushioning packaging device for liquid crystal glasses of claim 7, wherein at least one groove engageable with the corresponding supporting plate is defined at a bottom portion of each of the cushioning packing boxes.

10. The drawer type cushioning packaging device for liquid crystal glasses of claim 6, wherein the number of the standing posts of each of the supporting brackets is two.

* * * * *